US006733324B1

(12) United States Patent
Lecsek et al.

(10) Patent No.: US 6,733,324 B1
(45) Date of Patent: May 11, 2004

(54) COAXIAL HEAT SINK CONNECTOR

(75) Inventors: Robert Leslie Lecsek, Cambridge (CA); Shawn Robert Payne, Cambridge (CA)

(73) Assignee: Com Dev Ltd., Cambridge (CA)

( * ) Notice: Subject to any disclaimer, the term of this patent is extended or adjusted under 35 U.S.C. 154(b) by 0 days.

(21) Appl. No.: 10/407,242

(22) Filed: Apr. 7, 2003

Related U.S. Application Data

(60) Provisional application No. 60/431,237, filed on Dec. 6, 2002.

(51) Int. Cl.[7] ..... H01R 13/00
(52) U.S. Cl. ..... 439/485; 361/704
(58) Field of Search ..... 439/485, 487; 361/704, 707, 687; 257/219; 417/423.1

(56) References Cited

U.S. PATENT DOCUMENTS 4,189,683 A * 2/1980 Fassett et al. ..... 330/287
4,506,939 A * 3/1985 Faulkenberry et al. ..... 439/63
4,588,963 A * 5/1986 Eisenhart ..... 331/56
5,030,961 A * 7/1991 Tsao ..... 343/700 MS
5,124,883 A * 6/1992 Bakker ..... 361/720
6,146,208 A 11/2000 Pennell
6,623,279 B2 * 9/2003 Derian et al. ..... 439/74

* cited by examiner

*Primary Examiner*—Ross Gushi
*Assistant Examiner*—Phuongchi Nguyen
(74) *Attorney, Agent, or Firm*—Bereskin & Parr; Isis E. Caulder

(57) ABSTRACT

A coaxial heat sink connector for providing a thermal path from the conductors associated with a coaxial cable connector to a heat sink includes a center conductor, an outer conductor, an insulative layer, TNC connector(s) and a thermal element. The outer conductor is positioned around the center conductor and the insulation layer is positioned between. The insulation layer has high thermal conductivity to provide substantial heat transfer between the center and outer conductors. TNC connector(s) are positioned at the end(s) of the connector and electrically coupled to the center and outer conductors. The thermal element is coupled to the outer conductor to conduct heat from the outer conductor to the heat sink. Heat sink connector providing transfer paths for bolted together RF components as well as individual RF power components.

9 Claims, 5 Drawing Sheets

COAXIAL HEAT SINK CONNECTOR

This regular application claims priority from provisional U.S. Application No. 60/431,237 filed Dec. 6, 2002.

FIELD OF THE INVENTION

This invention relates to coaxial cable equipment and more particularly to a coaxial heat sink connector.

BACKGROUND OF THE INVENTION

The power handling capability of radio frequency (RF) components is significantly affected by the design of interconnecting coaxial RF cables ("coax"), which are widely used to connect RF components due to their large bandwidth capabilities. Heat dissipated in RF cables is generally transferred to the environment through radiation from the RF cable, and through conduction from the ends of the RF cable to the cable-connected RF components. In ground applications, convection helps reduce cable temperatures and accordingly, center conductor temperatures. In the case of electronic components for use in space applications, since there is no mechanism for convective heat transfer from the outer cable surfaces, other means of providing heat dissipation must be considered.

Generally, the length, design, and power level of the RF cables have a significant impact on the power-handling capability of RF components. This is especially the case in the thermal design of RF components for space applications, as the worst-case temperatures, de-rated power levels and worst-case dissipation specifications combine to ensure that temperature predictions bound any kind of flight applications. Fault conditions become especially difficult to design for, as typical fault scenarios result in full reflection of RF power through the RF cables, the RF cable connectors and the RF components. This full reflection can result in almost twice the rated power passing through an RF cable.

As shown in FIG. 1, RF cables 10 which are used in space applications are conventionally clamped to a heat sink (not shown) using a cable clamp 12. A heat sink is a device that is attached to heat generating equipment to prevent overheating by absorbing heat from the equipment and dissipating it into the immediate environment. This kind of assembly as shown in FIG. 1 provides a conduction point (i.e. at the cable clamp 12) for heat transfer from RF cable 10 and also ensures that RF cable 10 structurally adheres to a support structure. However, since the ends of RF cable 10 are too rigid to make suitable physical contact with cable clamp 12, cable clamp 12 must be positioned near the center of RF cable 10. Accordingly, this arrangement does not consistently sink heat from the center conductor of RF cable 10 and RF components.

In space applications, it is desirable to reduce the mass and equipment footprint of RF component assemblies and to reduce RF losses generally. By what is conventionally known as "bolting" together high power components using connectors instead of intermediate RF cables, several improvements can be realized. First, there is a substantial reduction of mass when components are bolted together as compared to when they are RF cabled together. As shown in FIG. 2, RF power components (e.g. circulators 14 and switches 16) are typically connected by long sections of RF cable 10 as long sections are required to minimize the thermal stress on RF cable 10 for durability and long life. Typically, each RF cable 10 is at least 6 inches (15.3 cm) long with each pair of cables having a typical mass of 45 grams. Moreover, when several pairs of these cables are used the cumulative mass can be appreciable. Also, there is an improvement in RF performance due to the absence of RF losses associated with an intermediate cable.

Further, when RF components are bolted together, the equipment footprint of the complete assembly is slightly larger than the cumulative footprint of the individual components (due to the short length of TNC connectors). In contrast, when RF cables are used between components, a suitable spacing is required to house the lengthy RF cables, and as a result the assembly has a larger overall footprint. Accordingly, the RF-cabled assembly takes up more room on a spacecraft, has a higher overall mass, and has a higher overall cost. FIG. 2 illustrates a spacecraft panel comprising of circulators 14 and switches 16 using RF cables 10 to interconnect flight components that could otherwise be bolted together. As shown, the width of a cable-connected panel layout is 16 inches (40.7 cm). In this case, the RF cables 10 that are used to attach circulators 14 to switches 16 are 5 inches (12.7 cm) long, and accordingly are a critical limiting factor for the overall panel width. Without the interconnecting cables, the width of this panel can be reduced by approximately 4 inches (10.2 cm).

However, when RF components are directly connected through connectors without the need for cables, the power-handling capability of the components is substantially reduced. First, when two high power components are bolted to each other, they interact with each other thermally (i.e. one component heats up the other). Also, RF cables provide radial heat transfer from the center conductor to the outer sheath, and when this radial thermal heat path is absent, the center conductors of the individual components become hotter than they would otherwise be, thus further limiting the power-handling capability of multiple power component assemblies. Also, conventional RF cable connectors are not designed to provide heat sinking functionality between RF components. Rather, RF cable connectors typically use a Teflon-based insulation layer between the center and outer conductors, which does not promote conduction of heat from the center conductor to the outer conductor due to its poor thermal conductivity.

SUMMARY OF THE INVENTION

The invention provides in one aspect, a heat sink connector for providing a heat transfer path from the conductors of a first coaxial cable connector to a heat sink, said heat sink connector comprising:

(a) a body comprising:
  (i) a center conductor;
  (ii) an outer conductor disposed around said center conductor;
  (iii) an insulation layer positioned between said center conductor and said outer conductor, said insulative layer being selected to have a substantially high degree of thermal conductivity such that a substantial amount of heat is conducted from the center conductor to the outer conductor;

(b) a first connector positioned at one end of said body, said first connector being electrically coupled to said center conductor and said outer conductor, said first connector being adapted to electrically couple said center and outer conductors to the conductors of the first coaxial cable connector; and (c) a thermal element coupled to the outer conductor, said thermal element having a surface adapted to be coupled to a heat sink such that said heat sink connector provides a heat transfer path from the conductors of the first coaxial cable connector to the heat sink through said center and outer conductors.

Further aspects and advantages of the invention will appear from the following description taken together with the accompanying drawings.

DETAILED DESCRIPTION OF THE INVENTION

Figure 1:
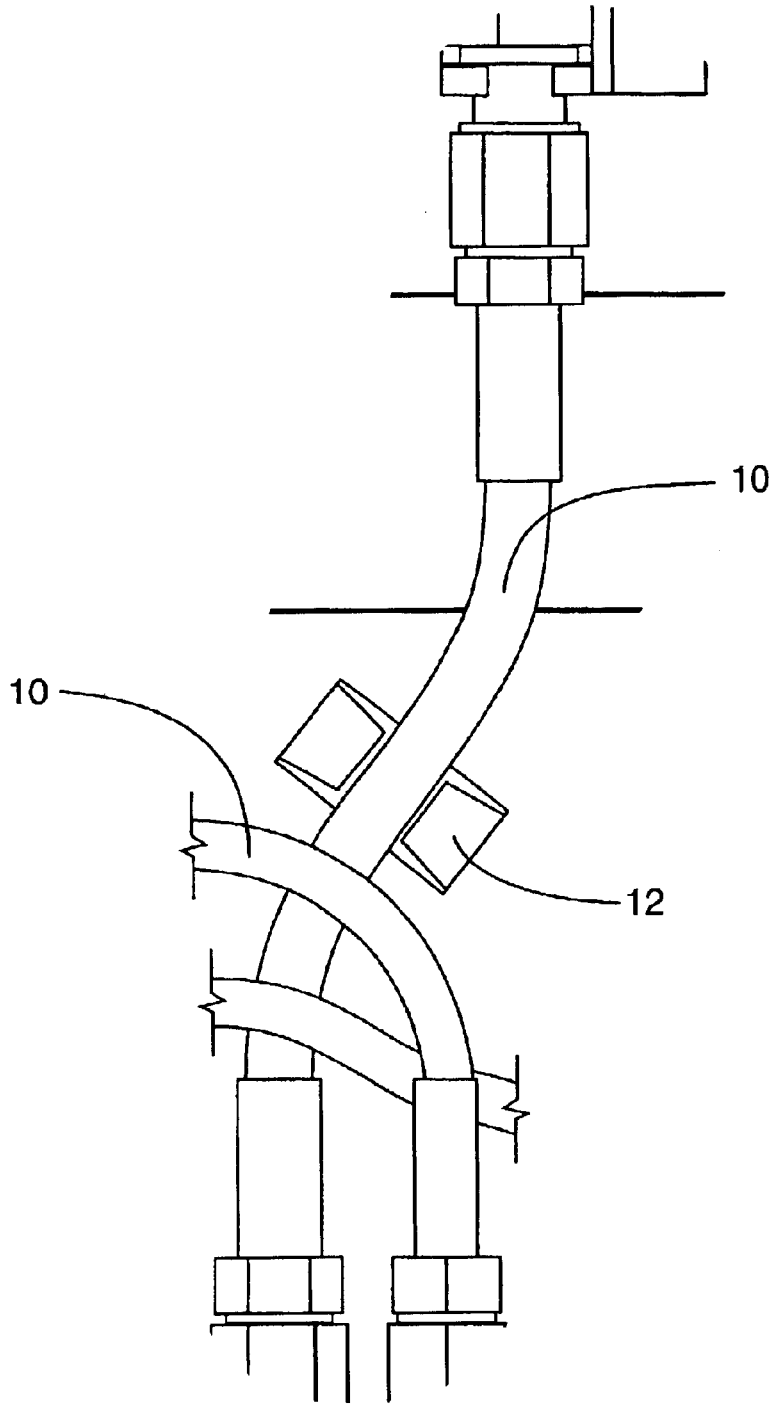
FIG. 1 (PRIOR ART)
FIG. 1 is a top view of a prior art RF cable assembly showing how a cable clamp can be used to couple a RF cable to a heat sink.
Figure 2:
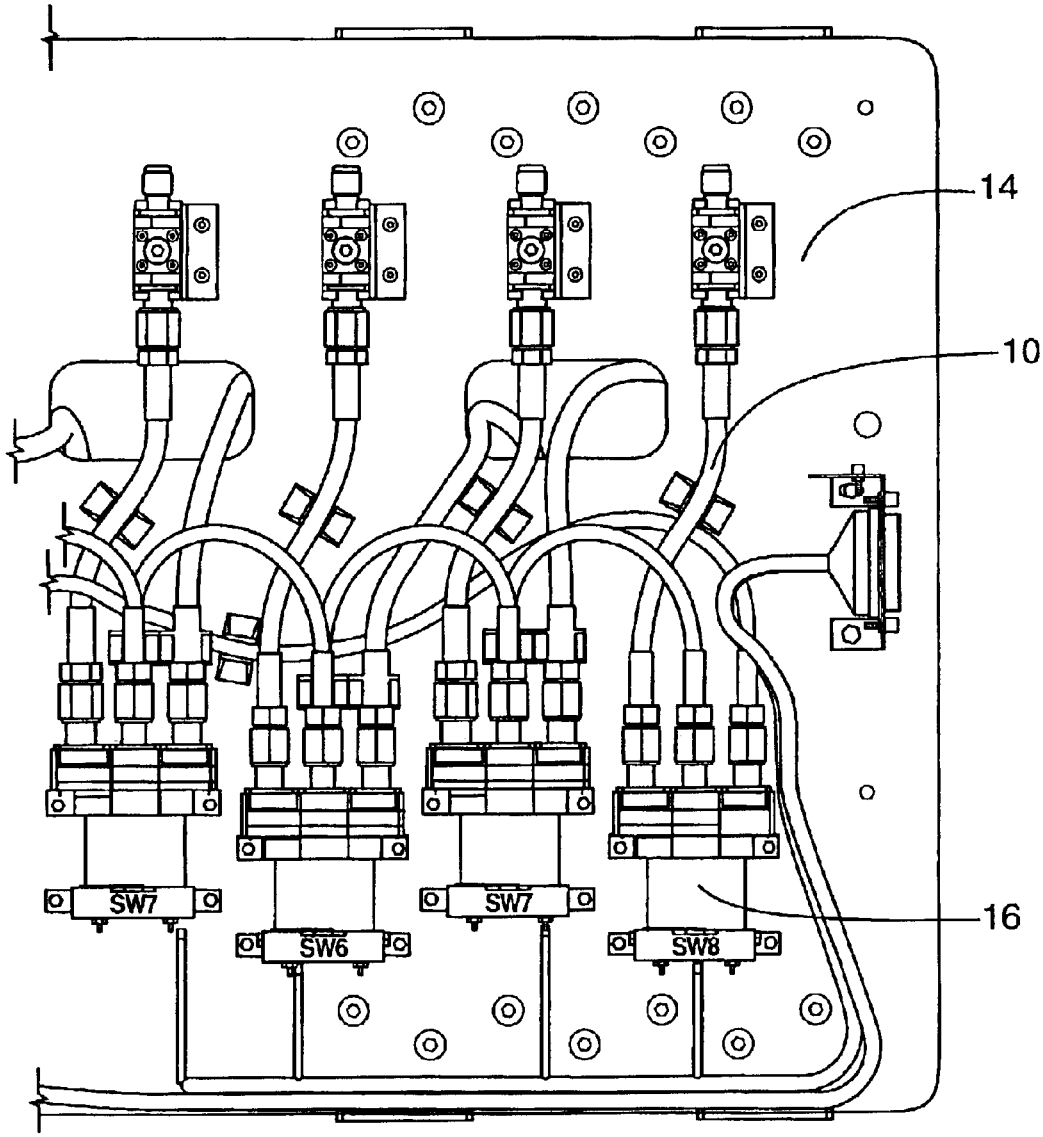
FIG. 2 (PRIOR ART)
FIG. 2 is a top view of a prior art RF cable-connected power component spacecraft panel layout showing how RF cables are used to interconnect RF power components.
Figure 3:
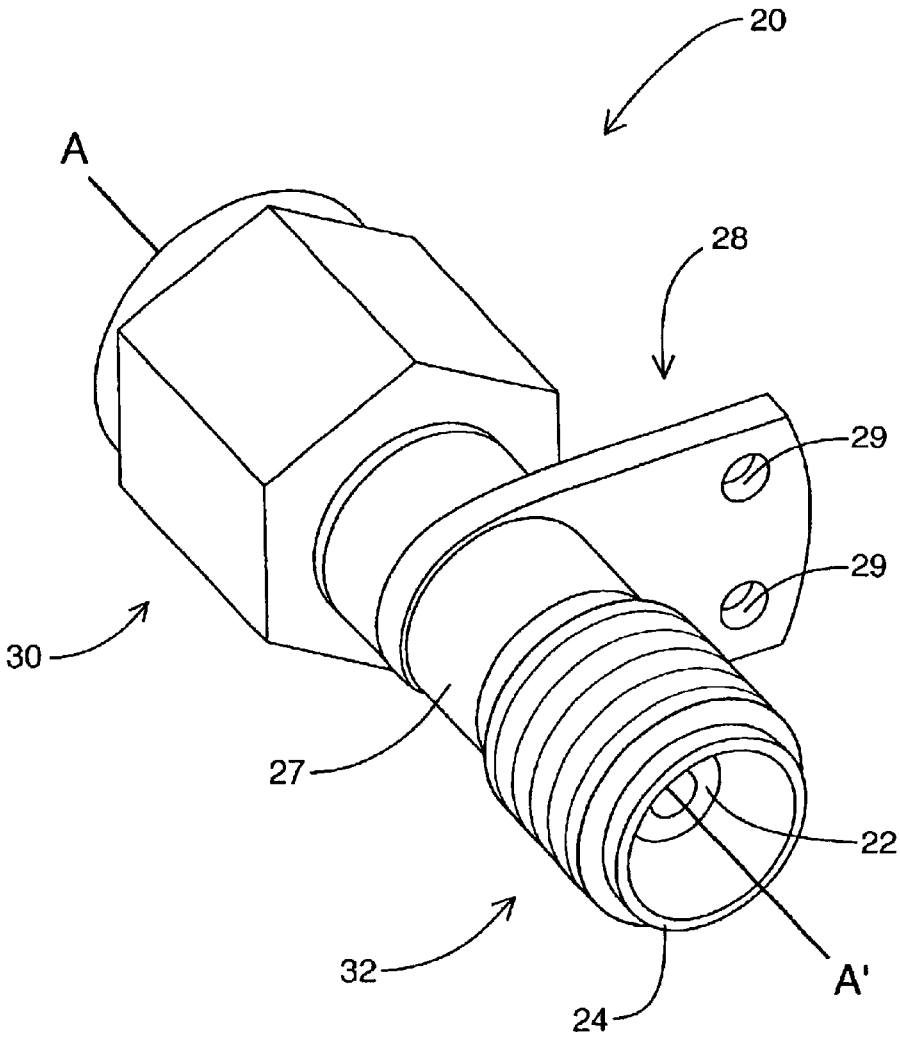
FIG. 3 is a side perspective view of the co-axial heat sink connector of the present invention.
Figure 4:
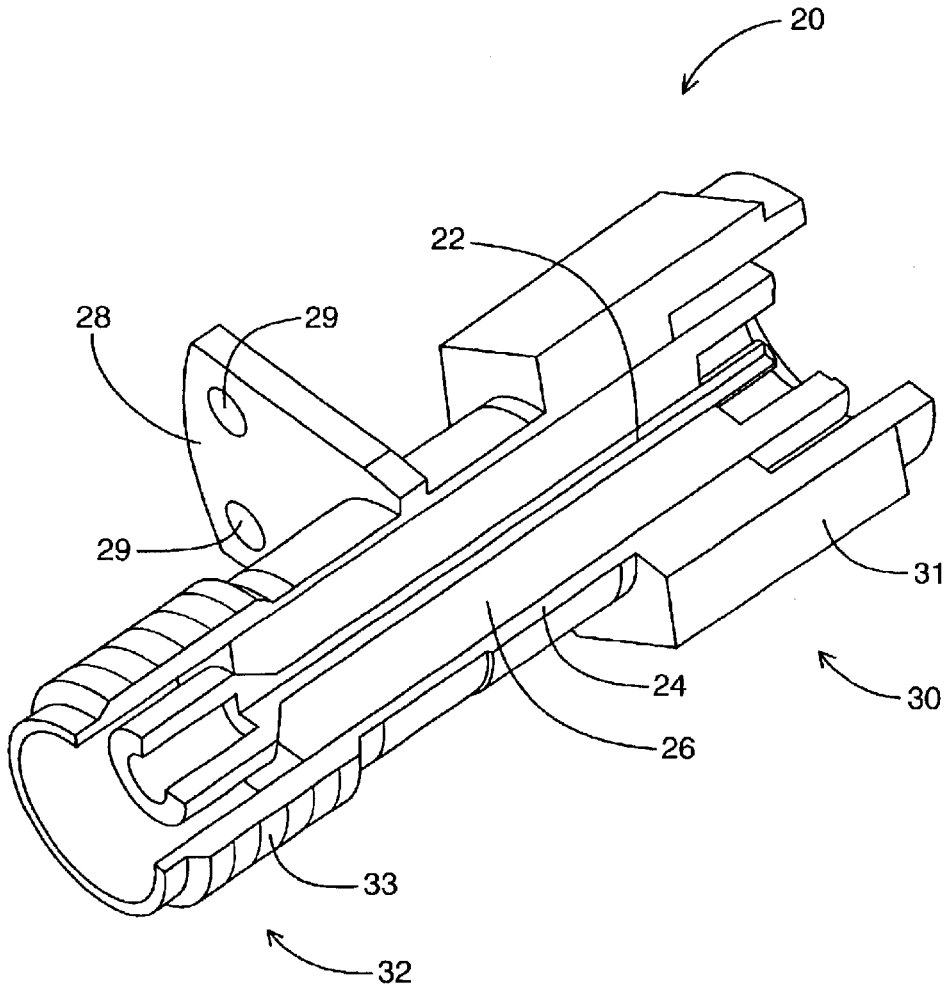
FIG. 4 is a longitudinal partial cut-away view of the co-axial heat sink connector of FIG. 3 taken along the line A–A'.

FIGS. 3 and 4 illustrate a heat sink connector 20 built in accordance with the present invention. Specifically, heat sink connector 20 includes a center conductor 22, an outer conductor 24, an insulation layer 26, a thermal element 28, a male TNC connector 30 and a female TNC connector 32. As will be described, heat sink connector 20 provides an efficient method of sinking heat from the center and outer conductors of attached RF power components or RF cables to a spacecraft environment. Heat sink connector 20 increases the power handling ability of the overall component assembly and isolates RF power components from the heat loads associated with connecting cables preventing associated detrimental effects. Heat sink connector 20 also allows for effective thermal isolation of bolted together RF components.

Center conductor 22 is a conventional TNC center conductor and is made of an electrically conductive material (i.e. a solid metal wire). Center conductor 22 is covered by insulation layer 26 (FIG. 4). The thickness and other physical dimensions of center conductor 22 is related to the desired impedance of heat sink connector 20 (which also depends on the dielectric constant of insulation layer 26).

Outer conductor 24 surrounds insulation layer 26 and has the thickness and other physical dimensions of a conventional TNC outer conductor. Outer conductor 24 may be a braid, a foil or a solid metal.

Insulation layer 26 is formed out of an insulator, and is preferably a dielectric material with high thermal conductivity. For example, insulation layer 26 can be comprised of Fluoroloy™ dielectric material (manufactured by Furon Saint-Gobain, France) that has high thermal conductivity, provides a high degree of heat transfer, and minimizes material creep deformation. Thermal conductivity is a property of materials that expresses the heat flux f ($W/m^2$) that will flow through the material if a certain temperature gradient $\Delta T$ (K/m) exists over the material. Fluoroloy dielectric material is five times more thermally conductive than the Teflon™ (manufactured by Dupont of Delaware) dielectric material conventionally used in TNC connectors. Specifically, the thermal conductivity of Fluoroloy H is 1.21 W/m C, while that of Teflon PTFE is 0.24 W/m C. Accordingly, insulation layer 26 is designed to provide a high degree of heat transfer from center conductor 22 to outer conductor 24.

While it is preferred for insulation layer 26 to have a high thermal conductivity, any material having a thermal conductivity higher than that of Teflon (i.e. greater than 0.24 W/m C) would be suitable for application within heat sink connector 20. At the same time, it is important to ensure that the relative coefficients of thermal expansion (CTE) of insulation layer 26, center conductor 22, outer conductor 24, male and female TNC connectors 30 and 32 are such that, when heated, insulation layer 26 and the other components sufficiently expand to maintain good material contact at the inner and outer interfaces of male and female TNC connectors 30 and 32.

Male TNC connector 30 is provided on one end of heat sink connector 20 and a female TNC connector 32 is provided on the other end. Connectors 30 and 32 are conventional TNC connectors adapted to receive the female and male TNC connectors and fastening elements, respectively of a conventional cable connector assembly. Male TNC connector 30 includes a conventional adaptor nut 31 having internal threads (not shown) for conventional coupling to a female TNC cable connector which is typically provided on the signal inputs and outputs of an RF power component. Female TNC connector 32 has external threads 33 for conventional coupling to male TNC connectors on RF cables. The configuration of male and female TNC connectors 30 and 32 discussed above can be used to couple heat sink connector 20 between a RF component (i.e. typically having a female connector) and a RF cable connector (i.e. typically having a male connector). RF components typically feature female connectors at their signal inputs and outputs in order to minimize breakage of the center conductor prong.

Generally, it should be understood that while heat sink connector 20 has been shown in association with a male/female connector pair, it could be just as easily be constructed using any configuration of TNC connectors (e.g. as an adaptor with male/male or female/female) as appropriate for a particular application (i.e. depending on the TNC cable connection requirements between electrical components at issue). For example, it is also contemplated that heat sink connector 20 be used to "bolt" together RF components, each of which would have female TNC connectors. Accordingly, heat sink connector 20 could just as easily be provided with two male TNC connectors 30, one at each end. It is also contemplated that heat sink connector 20 be constructed having only one male or female TNC connector as required for a particular heat sink application. Specifically, heat sink connector 20 constructed with only one male or female TNC connector would provide heat sink capability to a single TNC cable or an individual piece of equipment having a complementary TNC cable connector.

Thermal element 28 is configured as a tab and is used to provide a heat-sinking path from outer conductor 24 to an external heat sink bracket (not shown). thermal element 28 is a substantially rectangular planar segment that is coupled to outer conductor 24 through a section of the outer shell 27. Thermal element 28 is designed to protrude from the outer shell 27 with sufficient clearance and surface area to form thermal contact with an external heat sinking bracket which in turn absorbs the heat from thermal element 28 and dissipates this heat from heat sink connector 20 to a heat sink. Thermal element 28 contains holes 29 through which fasteners (not shown) can be used to bolt thermal element 28 to the external heat sinking bracket. It should be understood that any kind of conventional coupling mechanism can be used within thermal element 28 to allow for thermal contact with an external heat sinking bracket (e.g. a slotted arrangement). It should be understood thermal element 28 could be any other shape which has a surface adapted to be coupled to the outer conductor and to a heat sink.

Figure 5:
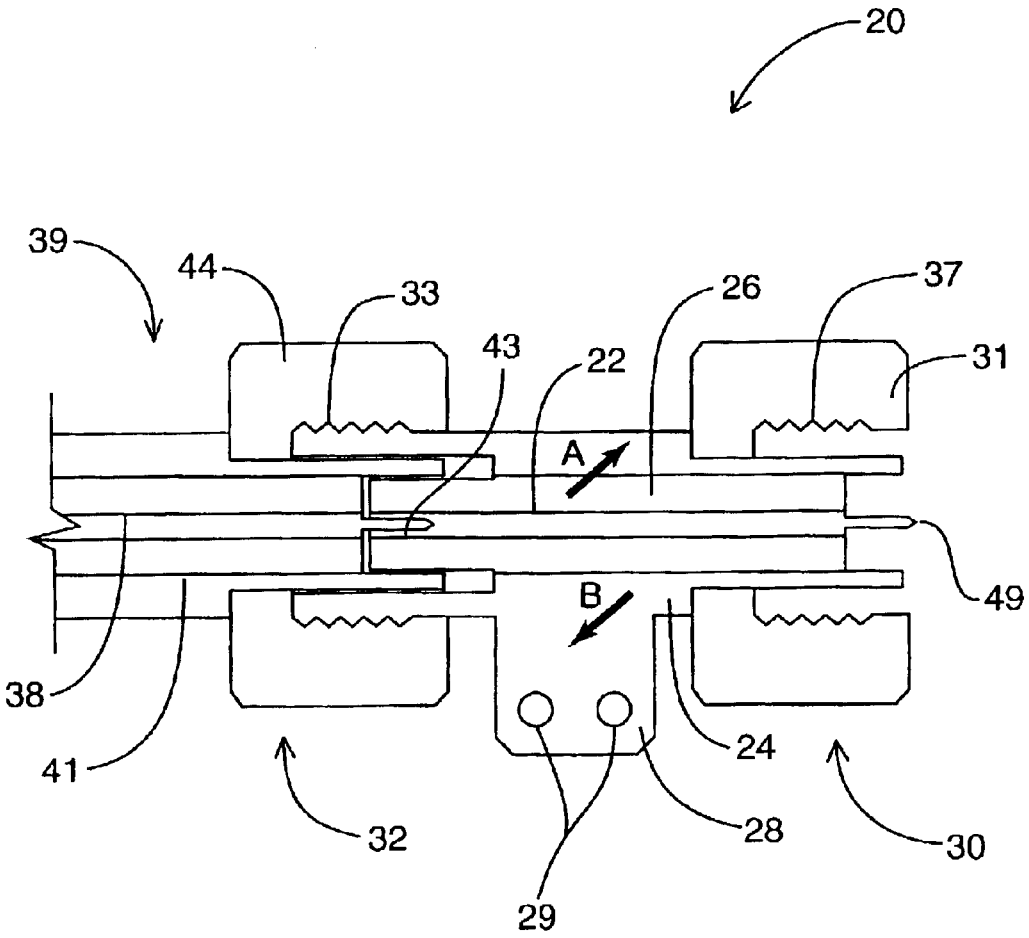
FIG. 5 is a cross-sectional view of the co-axial heat sink connector of FIG. 3 engaged with a male TNC cable connector taken along the line A–A'.

As shown in FIG. 5, when heat sink connector 20 is connected to a TNC male cable connector 39, heat sink connector 20 provides the conductors of the TNC male cable connector 39 with two critical heat paths. Specifically, the external threads 33 of female TNC connector 32 are engaged by the threads of the male TNC adaptor nut 44 of TNC male cable connector 39, such that the center conductor prong 43 is electrically coupled to center conductor 22 of heat sink connector 20. In a conventional manner, TNC male cable connector 39 electrically couples center cable conductor 38 and outer cable conductor 41 to the center conductor 22 and outer conductor 24, respectively as shown. Similarly, a TNC female cable connector (not shown) would normally be engaged by internal threads 37 of male TNC connector 31 such that center conductor prong 49 would be electrically coupled to the center conductor of TNC female cable connector. The first heat path provided by heat sink connector 20 is the radial heat path (see arrow A in FIG. 5) from center conductor 22 (which receives heat from center conductor prong 43) to outer conductor 24. The second path (see arrow B in FIG. 5) is from outer conductor 24 to the thermal element 28.

The length of heat sink connector 20 is dictated by the longitudinal dimension of male TNC connector 30, female TNC connector 32 and the necessary clearance required by thermal element 28. Given the conventional dimensions of the TNC male and female connectors and the relatively minimal clearance required for access to thermal element 28, the overall lengthwise dimension of heat sink conductor 20 can be comparable to that of a conventional TNC cable connector, and as little as 1 inch (2.54 cm). Heat sink connector 20 can be bolted between a RF power component and RF cables to prevent heat loads from connecting RF cables from causing detrimental effects on the RF component. Alternatively, heat sink connector 20 can be coupled between two critical RF power components. Because heat sink connector 20 is relatively short and of low mass, it does not have a significant impact on component assembly footprint or overall component assembly mass.

Heat sink connector 20 provides heat paths to dissipate heat within coaxial cable equipment that conventionally limits the power handling capability of a RF power component. Based on a thermal analysis, the inventors contemplate that heat sink connector 20 can reduce the temperature of the center conductors of high RF power components by 10 degrees Celsius. This decrease corresponds to a 20% increase in power handling capability of RF components which are bolted together, given the current power-handling limit. Further, by using heat sink connector 20 instead of RF cables for heat isolation of RF components, a significant reduction in size, weight and cost for high power RF component assemblies can be achieved as discussed above.

Accordingly, heat sink connector 20 provides an efficient mechanism for transferring heat from the center conductor of RF cables and RF power components to a heat sink bracket. Heat sink connector 20 allows for effective thermal isolation of bolted together RF components by providing a heat transfer path for RF connections. Heat sink connector 20 can also be bolted between a RF power component and a RF cable to prevent heat loads from the RF cable from causing detrimental effects on the RF component. Finally, heat sink connector 20 having only one male or female TNC connector can provide heat sink capability to a single TNC cable or an individual piece of equipment having a complementary TNC cable connector. Heat sink connector 20 provides an especially critical benefit where power handling within a RF component assembly is a critical design requirement. Also, since the male and female TNC connectors 30 and 32 can be easily attached and detached from other connectors on RF power equipment or TNC cables, heat sink connector 20 can be conveniently utilized within conventional RF power component assemblies.

It is contemplated that heat sink connector 20 can be used in a wide variety of applications including flight multiplexer assembly hardware and high power test setups. As is conventionally known, a multiplexer (MUX) is a component consisting of bandpass filters multiplexed on a common manifold. Its purpose is to combine individual channels of RF signals into a single unit, which are subsequently beamed back to earth from an orbiting satellite. Multiplexers can be designed and manufactured as individual multiplexers or as combined assemblies of multiplexers with complex input circuits. The input circuits consist waveguides or RF cables which route signals through switches to provide a redundancy network in which RF signals can be transferred from various amplifiers to specific channel filters.

Proper thermal design of this redundancy network is critical since fault scenarios contemplate a doubling of input RF power back through RF cables resulting in a significant heating effect on the center conductors of these RF cables. Consequently, the center conductors transfer heat to the components which these cables link together. Heat sink 20 allows for the isolation of RF components such a filter or switch from RF cable losses. Heat sink 20 can also provide similar functionality for high power RF test applications which are typically carried out in a thermal vacuum environment. Test RF cables also dissipate heat that can be detrimental to RF components. Heat sink connector 20 can isolate the RF component from the RF cable losses, and accordingly prevent unwarranted component testing failures.

It should be understood that the configuration of heat sink connector 20 could also be implemented for other types pf radio frequency connectors such as PTNC and SMA connectors. As will be apparent to those skilled in the art, various modifications and adaptations of the structure described above are possible without departing from the present invention, the scope of which is defined in the appended claims.

What is claimed is:

1. A coaxial heat sink connector for providing a heat transfer path from the conductors of a first coaxial cable connector to a heat sink, said heat sink connector comprising:

(a) a body comprising:

(i) a center conductor;

(ii) an outer conductor disposed around said center conductor;

(iii) an insulation layer positioned between said center conductor and said outer conductor, said insulative layer being selected to have a substantially high degree of thermal conductivity such that a substantial amount of heat is conducted from the center conductor to the outer conductor;

(b) a first connector positioned at one end of said body, said first connector being electrically coupled to said center conductor and said outer conductor, said first connector being adapted to electrically couple said center and outer conductors to the conductors of the first coaxial cable connector; and (c) a thermal element coupled to the outer conductor, said element having a surface adapted to be coupled to a heat sink such that said heat sink connector provides a heat transfer path from the conductors of the first coaxial cable connector to the heat sink through said center and outer conductors and thermal element.

2. The assembly of claim 1, wherein said insulation layer is a dielectric material having thermal conductivity greater than 0.24 W/m C.

3. The assembly of claim 1, wherein the insulation layer contacts said first connector as a first coupling interface and wherein the relative coefficient of thermal expansion of the insulation layer and the first connector is such that when heated, physical contact is maintained at the first coupling interface.

4. The assembly of claim 1 in combination with the heat sink, wherein said thermal element of said heat sink connector is coupled to the heat sink.

5. The assembly of claim 1 in combination with a coaxial cable associated with the first coaxial cable connector, wherein said first connector is coupled to the first coaxial cable connector.

6. The assembly of claim 1 for additionally providing a heat transfer path from the conductors of a second coaxial cable connector to the heat sink, said assembly further comprising a second connector positioned at another end of said body electrically coupled to said center conductor and said outer conductor and being adapted to electrically couple said center and outer conductors to the conductors of the second coaxial cable connector to the heat sink.

7. The assembly of claim 6, wherein the insulation layer contacts said first and second connectors at first and second coupling interfaces and wherein the relative coefficient of thermal expansion of the insulation layer and the first and second connectors is such that when heated, physical contact is maintained at the first and second coupling interfaces.

8. The assembly of claim 6, wherein said first connector is one of a male and female TNC (threaded nut connection) connector and the second connector is the other type.

9. The assembly of claim 6, wherein said first connector is one of a male and female (threaded nut connection) connector and the second connector is the same type.

* * * * *

UNITED STATES PATENT AND TRADEMARK OFFICE

CERTIFICATE OF CORRECTION

PATENT NO. : 6,733,324 B1
APPLICATION NO. : 10/407242
DATED : May 11, 2004
INVENTOR(S) : Robert Leslie Lecsek and Shawn Robert Payne It is certified that error appears in the above-identified patent and that said Letters Patent is hereby corrected as shown below:

In the Claims

Column 7, line 15, claim 3, the phrase "connector as a first coupling" has been changed to --connector at a first coupling--, so that the line reads --contacts said first connector at a first coupling interface and--.

Column 8, line 20, claim 9, the phrase "female (threaded nut connection)" has been changed to --female TNC (threaded nut connection)--, so that the line reads --is one of a male and female TNC (threaded nut connection)--.

Signed and Sealed this
Fifteenth Day of April, 2014

Michelle K. Lee

Michelle K. Lee
*Deputy Director of the United States Patent and Trademark Office*